United States Patent [19]

Packer et al.

[11] Patent Number: 4,993,505

[45] Date of Patent: Feb. 19, 1991

[54] DIAMOND INSERT GRINDING PROCESS

[75] Inventors: Scott Packer, Provo; Mike Lockwood, Heber City, both of Utah

[73] Assignee: Smith International, Inc., Houston, Tex.

[21] Appl. No.: 452,148

[22] Filed: Dec. 18, 1989

[51] Int. Cl.[5] ..... E21B 10/46

[52] U.S. Cl. ..... 175/329; 51/217 R; 175/411; 228/125; 407/118

[58] Field of Search ..... 175/329, 410, 411; 76/108.2; 407/118; 228/121, 124, 125, 164, 165, 168; 51/281 R, 289 R

[56] References Cited

U.S. PATENT DOCUMENTS 4,727,945 3/1988 Dennis ..... 175/410 X 4,813,187 3/1989 Mushardt ..... 51/281 R

*Primary Examiner*—Ramon S. Britts

*Assistant Examiner*—David J. Bagnell

*Attorney, Agent, or Firm*—Smith International, Inc.

[57] ABSTRACT

This invention comprises a diamond insert grinding process to remove stress riser cracks formed in a critical area of a tungsten carbide insert body. The cracks are caused by leaching of cobalt from the carbide during the process of brazing a tungsten carbide backed polycrystalline diamond disc to the body. A grinding wheel selectively removes material from the intersection of the braze below the depth of the cracks in the tungsten carbide body thereby relieving the stress riser in the critical area of the body.

8 Claims, 5 Drawing Sheets

DIAMOND INSERT GRINDING PROCESS

BACKGROUND OF THE INVENTION

1. Field of the Invention

This invention relates to diamond tipped tungsten carbide inserts, the body of the insert being inserted into apertures formed in a body of a rock bit.

More specifically this invention relates to a means to improve the ability of the body of the insert to withstand shear forces encountered by the diamond cutter insert as it is utilized in a rock bit in an earth formation.

2. Description of the Prior Art

Diamond cutter discs as well as diamond insert stud blanks, for example, are fabricated from a tungsten carbide. A tungsten carbide substrate has a diamond layer sintered to a face of the substrate. The disc is then brazed to the stud body. The diamond layer is composed of a polycrystalline material. The synthetic polycrystalline diamond layer is manufactured by Megadiamond, a division of Smith International, Inc. located in Provo, Utah. The diamond disc mounted to a stud body produced by Megadiamond is known as the M-40 cutter.

The tungsten carbide disc with the synthetic polycrystalline diamond layer secured thereto is normally brazed to a tungsten carbide stud. The stud is designed to be pressed or bonded within the face of a, for example, drag type rock bit.

During the brazing process the boron in the braze material leaches out the cobalt in the tungsten carbide stud body thereby forming a metallurgical "notch" or crack at the juncture of the braze and the tungsten carbide. This is especially detrimental where a braze fillet forms between the flat surface of the tungsten carbide insert body and the circumferential surface of the tungsten carbide substrate of the diamond disc. This rounded surface is perpendicular to the flat surface over at least half of the diameter of the disc. This phenomenon creates a stress riser at the filleted junction between the tungsten carbide substrate and the tungsten carbide body. The weakened juncture in the stud body limits the utility of the diamond cutter The cutter insert will not withstand severe shear forces created when the bit is rotated in a borehole.

If the tungsten carbide stud body breaks or shears under shear loads created when the drag bit cuts into a bottomhole formed in the earth formation, the broken cutting end of the stud then drops to the borehole bottom and destroys or damages the rest of the cutters on the bit thus shortening the life of the bit.

The prior art is therefore disadvantaged in that, as a result of the brazing process whereby the diamond cutter substrate is brazed to the end of a tungsten carbide body, leaching of the cobalt from the tungsten carbide body creates a multiplicity of metallurgical notches weakening the stud body at the juncture of the substrate and the body.

This invention directs itself to relieving these weakened areas by removing the area affected by the leaching process thereby strengthening the cutters tremendously.

SUMMARY OF THE INVENTION

An object of the present invention is to eliminate the affected area surrounding the braze utilized to secure a diamond cutter substrate to a tungsten carbide body.

Another object of the present invention is to provide a means to notch a portion of the juncture of the braze area between the substrate and the tungsten carbide body to remove the contaminated tungsten carbide material.

Still another object of the present invention is to provide a means to notch only part way around the circumference of the braze area adjacent the area most severely affected by the leaching process so that only that area that is affected by the leaching process is removed thereby increasing the shear strength of the tungsten carbide body.

A diamond tipped tungsten carbide cutter insert is disclosed consisting of a polycrystalline diamond disc mounted to a substrate. The substrate is subsequently brazed to a tungsten carbide insert body.

A diamond insert grinding process is disclosed to remove stress riser cracks or notches formed in a critical area of a tungsten carbide insert body. The cracks are caused by leaching of cobalt from the carbide during the process of brazing a tungsten carbide backed polycrystalline diamond disc to the insert body. The intersection of the braze and the tungsten carbide is selectively ground below the depth of the cracks in tungsten carbide body thereby relieving the stress riser in the critical area of the body.

Means are provided to notch the bottom side of the diamond cutter at the juncture of the braze joint to remove the leached area. The means to remove the contaminated or leached area is an abrasive grinding wheel that grinds out the affected area from the tungsten carbide to improve the ability of the insert to withstand shear forces generated during use of the diamond cutter insert in a borehole.

Means are provided to remove only the area that is most affected by the leaching process. A groove is ground about half way around the braze juncture thus removing the leached tungsten carbide material that most affects the strength of the tungsten carbide body.

An advantage then of the present invention over the prior art diamond inserts is the means in which an area of tungsten carbide affected by leaching is removed from the tungsten carbide insert to increase the ability of the stud body to withstand severe shear forces exerted on the cutter insert.

Yet another advantage of the present invention over the prior art is the means in which the area is notched at the bottom of the polycrystalline diamond cutter only half way around the braze juncture thus removing material only from the affected area that most affects the ability of the stud body to withstand shear forces.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
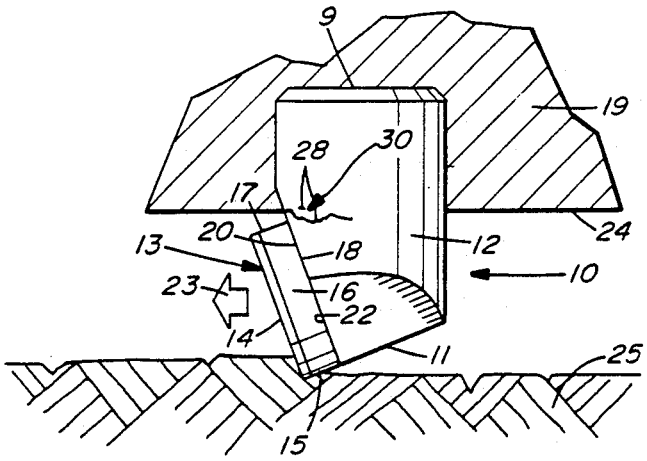
FIG. 1 (PRIOR ART)
FIG. 1 is a partially sectioned view of a prior art diamond insert mounted in a face of a drag bit, the diamond cutting tip being engaged with an earth formation.

With reference now to the prior art of FIG. 1, a polycrystalline diamond insert generally designated as 10 is shown mounted within the face 24 of a drag bit 19. The drag bit is shown operated in an earthen formation 25. Insert 10 has a base end 9 that is secured within the drag bit 19 and a cutting end 11 which is in contact with the earthen formation 25.

A polycrystalline disc generally designated as 13 is comprised of layer of polycrystalline diamond 14 sintered to a substrate disc 16, the composite diamond disc 13 being subsequently brazed to surface 22 formed in the insert body 12. The layer of braze material 18 between the substrate 16 and the insert body 12 forms an intersection 20 therebetween.

Figure 2:
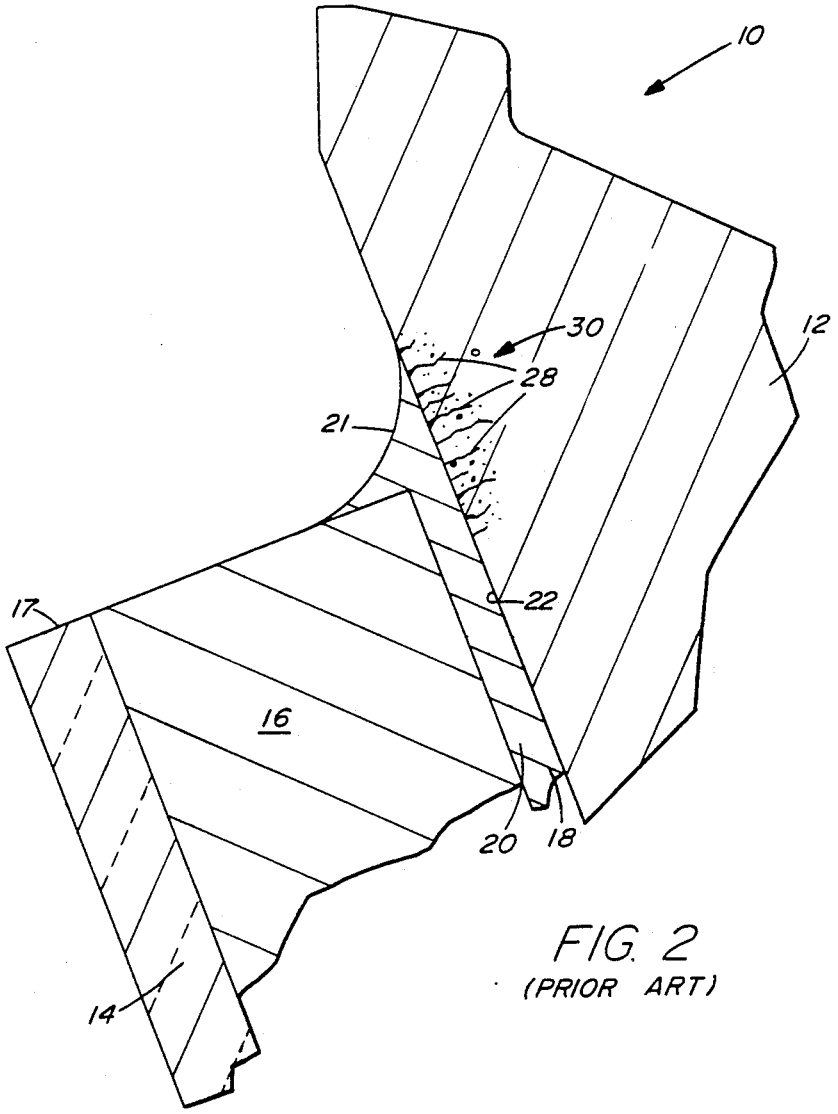
FIG. 2 (PRIOR ART)
FIG. 2 is an enlarged partial section ("A" of FIG. 1) of the prior art diamond insert illustrating the braze joint between the insert body and the tungsten carbide backed polycrystalline diamond cutter disc.

The encircled portion designated "A" and shown enlarged in the prior art of FIG. 2 indicates an area of very high stress due to the shear forces imparted to this section of the insert body 12 created by the action of the cutting end 15 engaged with the borehole formation 25. In prior art inserts, as indicated before, boron in the braze material robs or leaches cobalt from the tungsten carbide of the insert body 12 thus creating small cracks. These insert weakening cracks coupled with severe shear forces generated when the bit 19 is operated in a borehole may cause the insert to shear generally along a planar surface parallel with face 24 of the drag bit 19.

Referring now to the enlargement of FIG. 2, the intersection 20 between the substrate 16 and the body along face 22 of the body 12 is filled with a braze material 18. Generally a location 17 in the polycrystalline disc 13 (opposite to the cutting end 15 of the cutting disc 13) has a fillet 21 that tangents both the substrate 16 and the face 22 of the body 12. Boron in the braze leaches cobalt from the carbide creating notches or cracks 28 in this critical area of the insert 10.

Experimentation has shown that the flawed inserts of the prior art could only withstand shear forces of about 3,000 psi before they would shear off or break.

The inserts illustrated with respect to FIGS. 3-8 having the flawed area generally designated as 30 ground out, will withstand shear forces between 13,000 and 18,000 psi before breaking (an average of 14,000 psi). Area 30 is located at 17 opposite to cutting tip 15 of diamond disc 13. This tremendous increase in shear strength is quite surprising and is a significant advance in the art.

Again, the prior art of FIGS. 1 and 2 point out the notches 28 in the insert body 12 which critically affects the shear strength of the insert 10.

Figure 3:
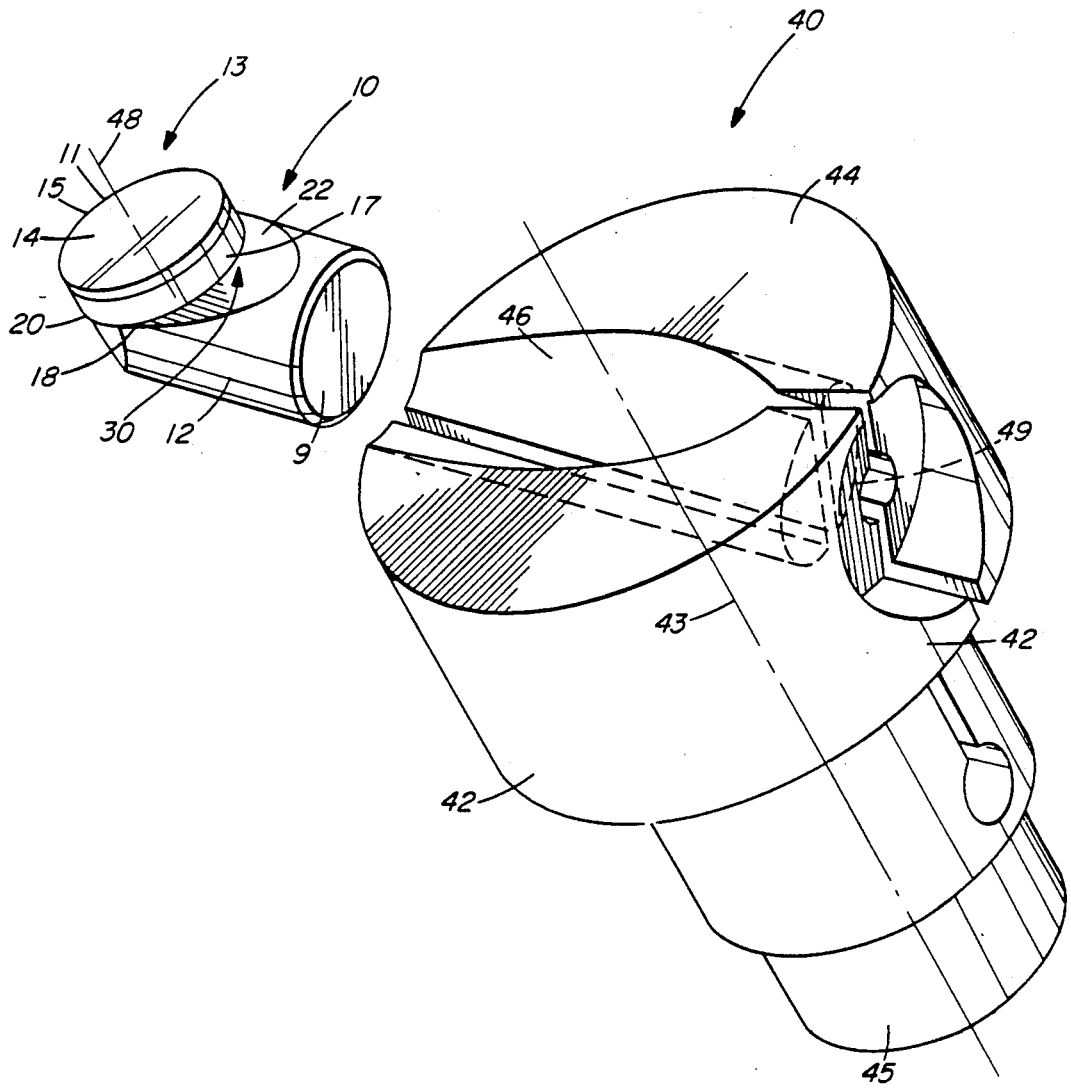
FIG. 3 is an exploded perspective view of a diamond insert and grinding fixture.

Referring now to FIG. 3, a grinding fixture generally designated as 40 provides a means to grind out the area shown as 30 in the prior art of FIG. 1 and 2 to remove the flaw in the insert 10.

The fixture 40 has a fixture body 42 that is rotatable about an axis 43. The body forms an upper flat surface 44 which is perpendicular to the axis 43.

Formed in the face 44 is an aperture 46 which has a circumference that will accept the body 12 of insert 10. Aperture 46 in body 42 of the fixture 40 is at an angle with respect to both surface 44 and axis 43 such that when the base 9 of the insert body 12 is inserted in the fixture, the plane of the surface 22 is parallel with the base of substrate 16 of the polycrystalline disc 13. In other words, the polycrystalline disc 13 is parallel with surface 44 of fixture 40. The insert is inserted within the fixture, base end first so that it bottoms out in the bore 46. A screw 49 (not shown) adjusts the base 9 of the insert 10 so that it is oriented properly with respect to the grinding operation. The fixture is designed to grind out the area 30 illustrated in the prior art of FIGS. 1 and 2, which again is at point 17 opposite to the cutting end 15 of the polycrystalline disc 13. The insert is secured within the fixture 40 such that the intersection 20 located through the braze material 18 and a portion of the surface 22 is raised above surface 44 of the body 42 of the fixture 40.

Figure 4:
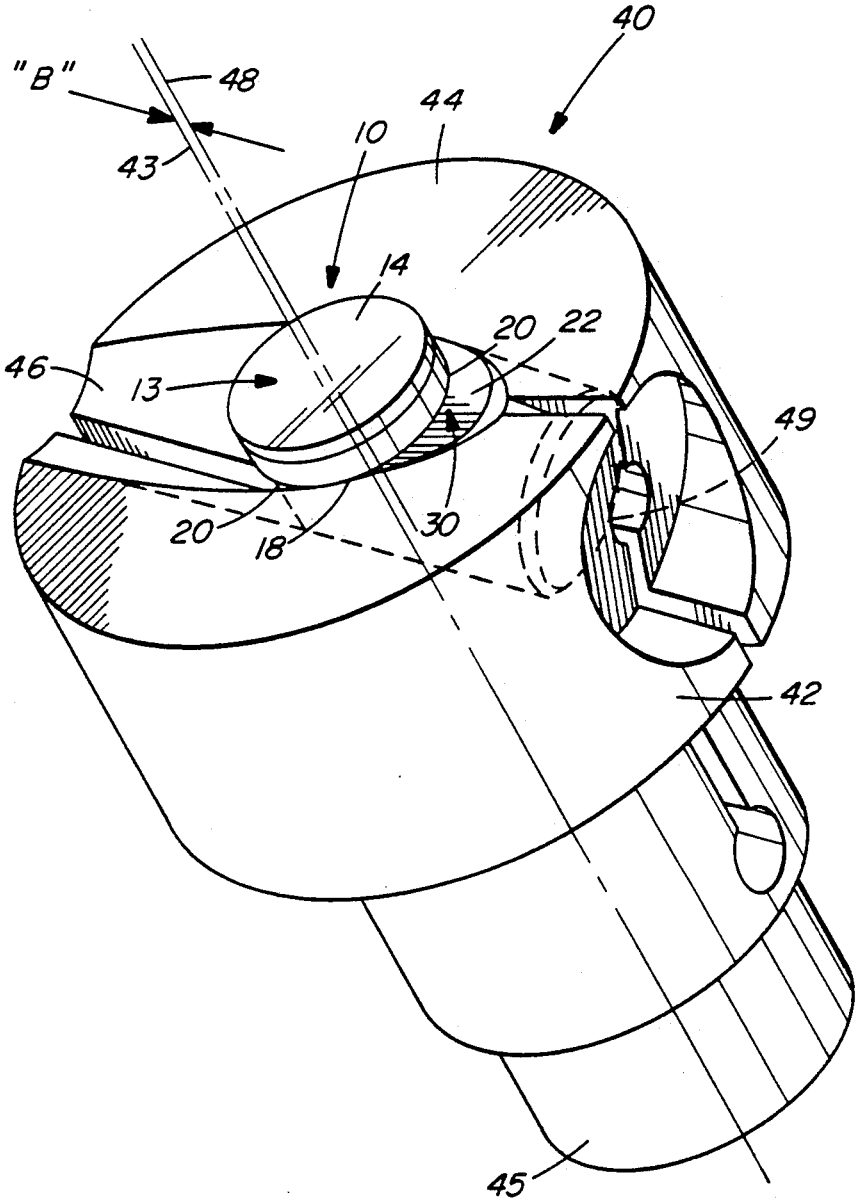
FIG. 4 is the grinding fixture with an insert mounted therein.

Referring to FIG. 4, the perspective view illustrates the insert 10 securely mounted within aperture 46 formed in face 44 of the fixture body 42. Again the set screw 49 establishes the depth of which the insert body 12 is inserted within bore 46 of the body 42. It is critical that the insert be precisely mounted within the fixture so that the axis 48 of the disc 13 is offset from or eccentric to axis 43 of the fixture 40. This distance "B" assures that the deepest penetration of the grinding wheel into intersection 20 occurs at point 17 (affected area 30) and progressively tapers away from the intersection 20 as the fixture 40 is rotated against the rotating grinding wheel shown in FIG. 5. The amount of eccentricity "B" establishes the depth of the grind in the critical area 30.

Figure 5:
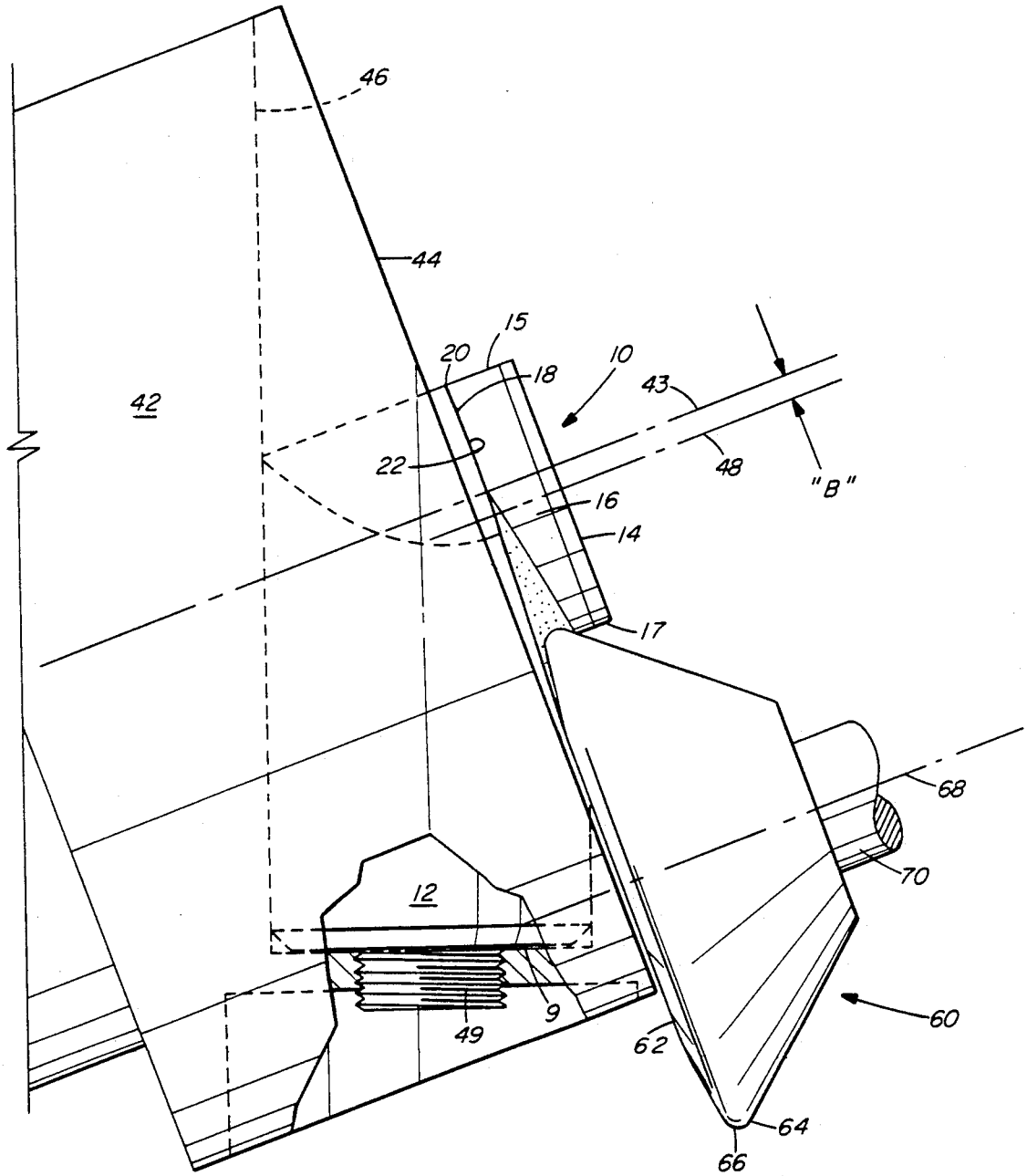
FIG. 5 illustrates a grinding wheel grinding out the leached area of tungsten carbide at the braze junction.

FIG. 5 shows the fixture 40 with the insert 10 mounted therein with the set screw 49 establishing the amount of eccentricity between axis 43 of the fixture body 42 and axis 48 of the polycrystalline disc 13. The grinding wheel, generally designated as 60, has an outer peripheral edge 64 that is rounded at 66. The shape of the radius 66 determines the radius of the grind at intersection 20 formed between substrate 13 and surface 22 of the insert body 12.

Obviously the grinding wheel 60 is independent of the rotating fixture body 42. The axis 43 of fixture body 42 and the grinder axis 68 of the grinder 60 are parallel with one another and planar surface 62 formed in wheel 60 is parallel with surface 44 of the fixture body 42. Shaft 70 of the grinding wheel 60 is rotated by a motor source (not shown). Similarly the base 45 of the fixture body 42 is independently rotated by a source that is not shown.

Figure 6:
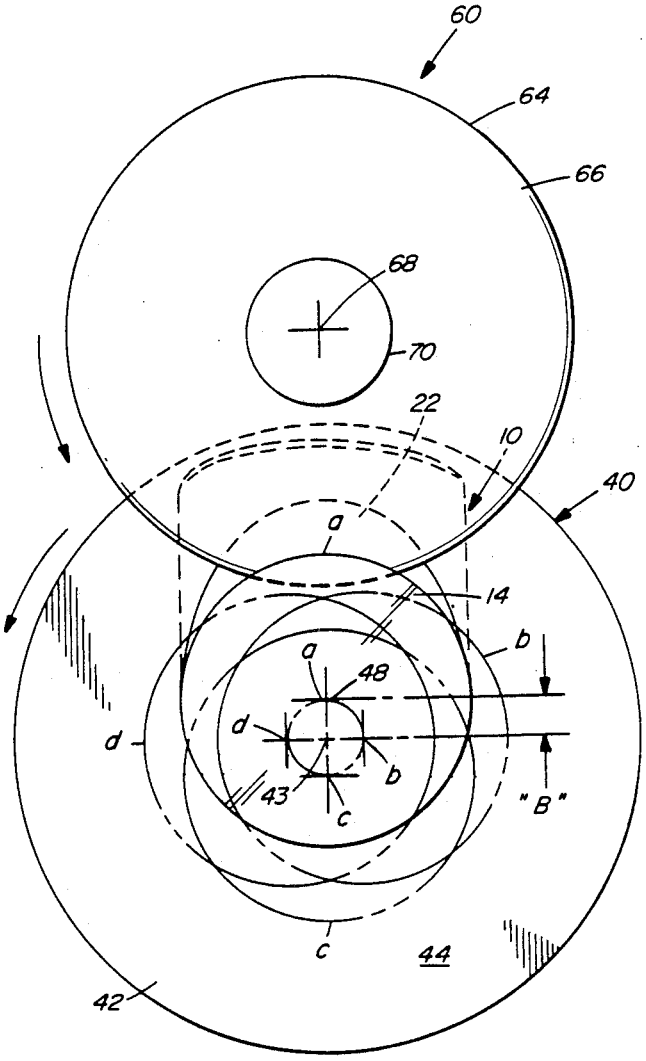
FIG. 6 is a schematic of the fixture and the grinding wheel with the insert diamond disc eccentrically mounted within the fixture.

The schematic of FIG. 6 illustrates the geometry of the separately rotating fixture 40 and grinder 60. The insert 10 is schematically shown mounted within face 44 of the fixture body 42 with the orientation such that area 17 (and notched area 30) of the polycrystalline disc 13 and tungsten carbide body 12 has the deepest penetration. The offset or eccentric axis 48 of the disc with respect to axis 43 of the fixture is such that the grinder grinds progressively less on opposite sides of area 17 of the disc 13. As illustrated schematically, when the insert body is positioned as shown with respect to the grinder 60, the deepest penetration "a" grinds out the notches in the insert body 12 (indicated as 30 in FIGS. 1 and 2).

When the fixture body 42 is rotated 90 degrees to position "b" the grinder grinds out less material, the grinding wheel eventually running away from the insert. The peripheral edge 64 of the grinding wheel 60 is completely free of the wheel at position "c" again contacting the wheel when the fixture rotates around to the "d" position back towards the deepest penetration as shown at position "a". Again the amount of distance "B" determines the depth of penetration of the grinding wheel 60 at insert position "a".

Figure 7:
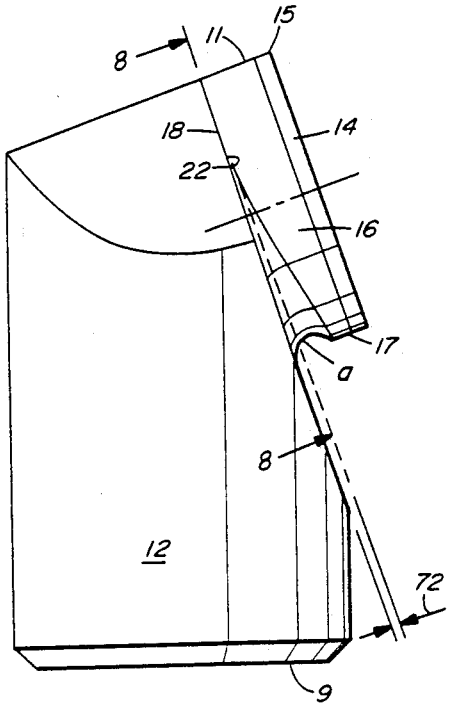
FIG. 7 is a side view of the insert after it is ground.

FIG. 7 illustrates the insert body 12 after grind showing the amount of grind (72) in the insert body 12 along surface 22 and the amount of grind in the braze 18 and the substrate 16 of the polycrystalline disc 13. The eccentricity causing the grinding wheel to grind out progressively less as the fixture 40 is rotated again due to the eccentricities between the disc 13 and the axis of the fixture 40.

Figure 8:
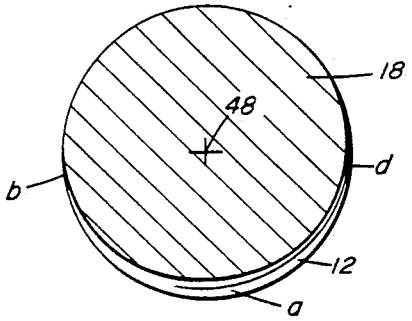
FIG. 8 is a view taken through 8—8 of FIG. 7 illustrating the partial grind at the braze juncture.

The FIG. 8 section view illustrates the ground out portion, the deepest portion being shown at "a" the grinding wheel running out of the intersection 20 as it approaches position "b" and "d".

It will of course be realized that various modifications can be made in the design and operation of the present invention without departing from the spirit thereof. Thus while the principal preferred construction and mode of operation of the invention have been explained in what is not considered to represent its best embodiments which have been illustrated and described. It should be understood that within the scope of appended claims the invention may be practiced otherwise than as specifically illustrated and described.

What is claimed is:

1. A diamond insert grinding process to remove stress riser cracks or notches formed in a critical area of a tungsten carbide insert body, said cracks being caused by leaching of cobalt from the carbide during a process of brazing a polycrystalline diamond disc having a tungsten carbide substrate sintered thereto to the insert body comprising the step of;

removing selectively, material from the intersection of the braze and the tungsten carbide base of said polycrystalline diamond disc and said tungsten carbide body below the depth of the cracks in the tungsten carbide body thereby relieving the stress riser in said critical area of the body.

2. The method as set forth in claim 1 further comprising the step of removing tungsten carbide and braze material from a braze intersection area adjacent the tungsten carbide base of the disc below the cutting portion of the diamond disc where the severest stress riser occurs in the tungsten carbide insert body.

3. The method as set forth in claim 2 wherein progressively less material is removed from said braze intersection area when moving away from said sever stress rise area.

4. The method as set forth in claim 3 wherein grinding is the step by which material is removed from said intersection.

5. A diamond insert comprising a tungsten carbide body, said body forming a first base end and a second cutter end, said second cutter end consisting of a polycrystalline diamond disc sintered to a tungsten carbide substrate, a base of the tungsten carbide substrate is subsequently joined by brazing to said tungsten carbide body whereby at an intersection formed between said substrate of said polycrystalline diamond disc and said body, material is removed from said braze and said tungsten carbide body to remove notches formed in said body when boron in said braze leaches out cobalt from said tungsten carbide body thereby relieving shear stress risers in said body.

6. The invention as set forth in claim 5 wherein the most severe stress riser resulting from said leached carbide material occur adjacent an edge of said diamond disc nearest said first base end of said tungsten carbide body, said material being primarily removed from the severe stress riser area formed in said body.

7. The invention as set forth in claim 6 wherein progressively less material is removed from the intersection between said insert body and said substrate when moving away from said severe stress riser area formed in said body.

8. The invention as set forth in claim 7 wherein said material is removed from said diamond insert by a grind operation.

* * * * *